US005301937A

United States Patent [19]

Hansch

[11] Patent Number: 5,301,937

[45] Date of Patent: Apr. 12, 1994

[54] METHOD AND APPARATUS FOR PROCESSING PRINTED PRODUCTS

[75] Inventor: Egon Hansch, Wetzikon, Switzerland

[73] Assignee: Ferag AG, Hinwil, Switzerland

[21] Appl. No.: 895,081

[22] Filed: Jun. 8, 1992

[30] Foreign Application Priority Data

Jun. 10, 1991 [CH] Switzerland ..... 01725/91-8

[51] Int. Cl.[5] ..... B65H 29/04

[52] U.S. Cl. ..... 271/204; 271/271

[58] Field of Search ..... 271/204, 271, 243, 244

[56] References Cited

U.S. PATENT DOCUMENTS

| | | | |
|---|---|---|---|
| 3,623,386 | 11/1971 | Bach et al. . | |
| 4,201,286 | 5/1980 | Meier . | |
| 4,333,559 | 6/1982 | Reist | 271/204 X |
| 4,489,930 | 12/1984 | Meier . | |
| 4,605,213 | 8/1986 | Hechler . | |
| 4,684,116 | 8/1987 | Hansch . | |
| 4,684,117 | 8/1987 | Honegger et al. . | |
| 4,709,910 | 12/1987 | Honegger . | |
| 4,729,554 | 3/1988 | Honegger . | |
| 4,893,805 | 1/1990 | Eberle | 271/204 |
| 5,052,667 | 10/1991 | Hansch . | |

FOREIGN PATENT DOCUMENTS

| | | |
|---|---|---|
| A10169490 | 1/1986 | European Pat. Off. . |
| 618398 | 7/1980 | Switzerland . |

*Primary Examiner*—Richard A. Schacher

*Attorney, Agent, or Firm*—Willian Brinks Hofer Gilson & Lione

[57] ABSTRACT

A method and apparatus is provided for processing printed products such as newspapers, magazines or parts thereof in which the printed products are transported by controllable grippers of a conveying device wherein the printed product is held at a first edge which runs transversely to the conveying direction. The printed products are conveyed at a set conveying speed. The grippers are at least partially opened to displace the printed products in the mouth of the grippers. The printed products are then displaced in the mouth of the grippers until the second edge (which is opposite the first edge) is brought to rest on a straightening mechanism. The straightening mechanism is driven substantially in the conveying direction. The grippers are then closed to continue transporting the printed products. If the second edge of the printed products leads relative to the first edge, the straightening mechanism is driven at a lower speed than the conveying speed. If the second edge trails relative to the first edge, the straightening mechanism are driven at a higher speed than the conveying speed. Thus, the printed products are thrust towards the interior of the mouth of the grippers by the straightening mechanism before the grippers are closed.

30 Claims, 2 Drawing Sheets

METHOD AND APPARATUS FOR PROCESSING PRINTED PRODUCTS

BACKGROUND OF THE INVENTION

This invention is related to U.S. Pat. application commonly owned Ser. No. 07/895,334, entitled "Method And Apparatus For Opening Folded Printed Products And Depositing Them On A Saddle-Type Rest" filed concurrently herewith.

The present invention relates to a method and an apparatus for processing printed products, such as newspapers, magazines or parts thereof and particularly to a method and apparatus for conveying printed products with controllable grippers of a conveying device.

A method and apparatus of this type are disclosed, for example, in EP-A-0,208,081 and the corresponding U.S. Pat. No. 4,684,116 and U.S. Pat. No. 4,684,117. In the arrangement disclosed in these references, the printed products are folded asymmetrically or off-centered. The folded printed products are then held or gripped at the fold by individually controllable conveying grippers of a conveying device and are transported, with the leading edge region which is open and opposite the fold. The printed products are transported in a conveying direction which runs obliquely in a downward direction. Positioned below the conveying device is an opening device with controllable opening grippers which are arranged on two mutually parallel circulating traction or drawing members. In order to bring the edge region of the printed products into the range of action of the opening gripper, the corresponding conveying gripper is opened briefly. As the conveying gripper is opened, the part of the printed product lying at the bottom slides into the mouth of the corresponding opening gripper. Further downstream, the traction member is deflected around a deflecting wheel. The deflecting wheel is arranged such that the deflection of the traction member is transverse to the conveying direction. As the traction member is deflected, the part of the product now held on the edge region by the opening gripper is moved away or separated from the non-held part of the product lying at the top. A collecting conveyor is introduced from below between the partially separated parts of the product. When the gripper is now opened, the printed product drops astride on the collecting conveyor.

An apparatus for opening folded printed products is disclosed in Swiss Patent Specification 667,859. In the disclosed arrangement, the printed products are held at the fold securely against rotation by the grippers of a conveying device. The printed products are also compressed by means of a pusher element which acts on an end region of the fold. An opening strip is introduced between the halves of the printed products starting from the compressed fold. In order for the strip to separate the two halves from one another from the region of the fold, the strip is moved along the relevant side edge of the printed product to the region of the open side edge opposite the fold. Each of the grippers have two clamping fingers which can be controlled independently of one another and a clamping jaw which interacts with the two clamping fingers. This arrangement holds the gripped printed products securely against rotation. In order to open the printed products completely, the clamping finger which is closest to the pusher element is moved into its open position. The effect of the pusher element on the fold positions the respective printed product obliquely. This allows a circulating opening cam to be introduced in the open edges of one-half of the printed product to hold that one-half of the printed product. The half of the printed product which is held by the opening cam is then deflected to separate it from the other half in some areas. A saddle-type rest of a collecting drum can then be inserted between the two halves. The other clamping finger then opens such that the printed product drops astride the saddle-type rest. With this apparatus, however, the printed products cannot be aligned for subsequent processing because the opened printed products become deformed under the effect of the pusher element.

When printed products are transported by means of conveying devices with individually controllable grippers, the position of each printed product relative to the relevant gripper is determined by the positioned of the printed product when it is gripped by the gripper. The printed products, therefore, often have different positions relative to their corresponding grippers. It is desirable and important, however, in some further processing operations of the printed products to have all of the printed products assume a precisely defined position.

Therefore, a primary object of the present invention is to provide a method and apparatus which precisely positions printed product relative to controllable grippers which transport the printed products.

SUMMARY OF THE INVENTION

To achieve this and other objects, a method and apparatus is provided for processing printed products such as newspapers, magazines or parts thereof in which the printed products are transported by controllable grippers of a conveying device wherein each printed product is held at a first edge which runs transversely to the conveying direction. The printed products are conveyed at a set conveying speed. The grippers are at least partially opened to displace the printed products in the mouth of the grippers. The printed products are displaced until the second edge (which is opposite the first edge) is brought to rest on a straightening mechanism. The straightening mechanism is driven substantially in the conveying direction. The grippers are then closed to continue transporting the printed products. If the second edge of the printed products leads relative to the first edge, the straightening mechanism is driven at a lower speed than the conveying speed. If the second edge trails relative to the first edge, the straightening mechanism is driven at a higher speed than the conveying speed. Thus, the printed products are thrust towards the interior of the mouth of the grippers by the straightening mechanism before the grippers are closed.

Thus, with this arrangement, during alignment, the printed products remain in the mouth of the grippers and are subsequently transported further by the same gripper. To align the printed products, the edge which determines the position for the further processing of the printed products is brought to rest on the straightening mechanism.

Straightening of the printed products in this manner is particularly advantageous if the printed products are fed to an opening device which, for opening, grips part of the respective printed product in the region of the edge by which the printed product was primarily aligned. This insures reliable opening of each printed product. Since after the products have been straightened, the position of the printed products is precisely defined relative to the grippers, a further processing station, such as, for example, the opening device, can be positioned at any desired distance downstream (in the conveying direction) from the straightening device.

Additional objects, advantages and novel features of the invention will be set forth in part in the description which follows, and in part will become apparent to those skilled in the art upon examination of the following description or may be learned by practice of the invention. The objects and advantages of the invention may be obtained by means of the combinations particularly pointed out in the appended claims.

BRIEF DESCRIPTION OF THE DRAWINGS

The present invention is now described in detail with reference to an exemplary embodiment shown in the drawings which are in schematic form.

DETAILED DESCRIPTION OF THE PRESENTLY PREFERRED EMBODIMENTS

Figure 1:
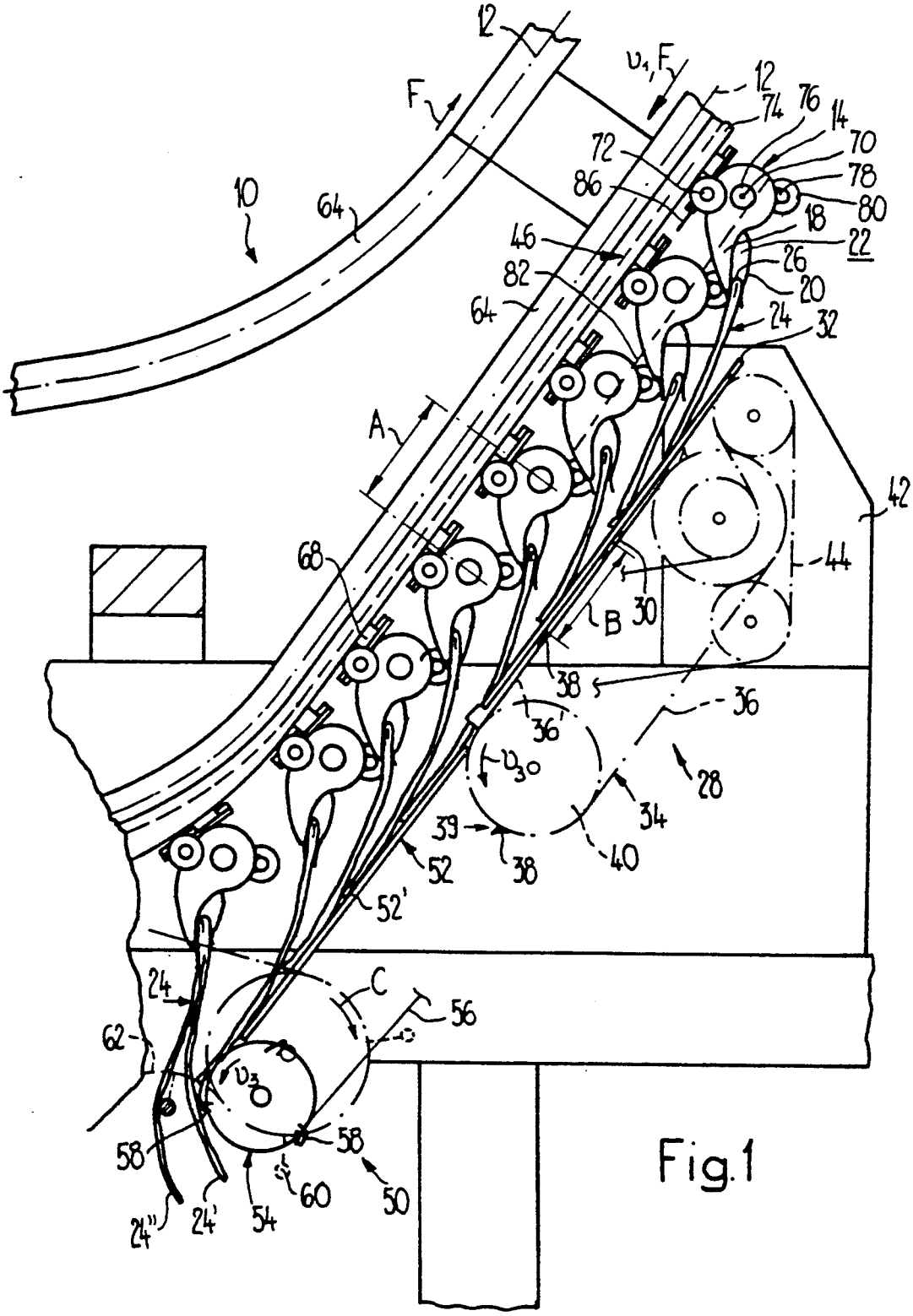
FIG. 1 illustrates a front view of part of a conveying device, with a straightening device arranged below the conveying device, and an opening device.

Referring to FIG. 1, a conveying device 10 includes individually controllable grippers 14 which are arranged one after another at a fixed distance A. An endless traction or drawing member 12 is revolvingly driven in a conveying direction F (indicated by a dot/-dashed lines in FIG. 1). Conveying devices of this type are generally known and are described in more detail, for example, in Swiss Patent Specification 644,816 and the corresponding U.S. Pat. No. 4,381,056, which are incorporated herein by reference.

Figure 2:
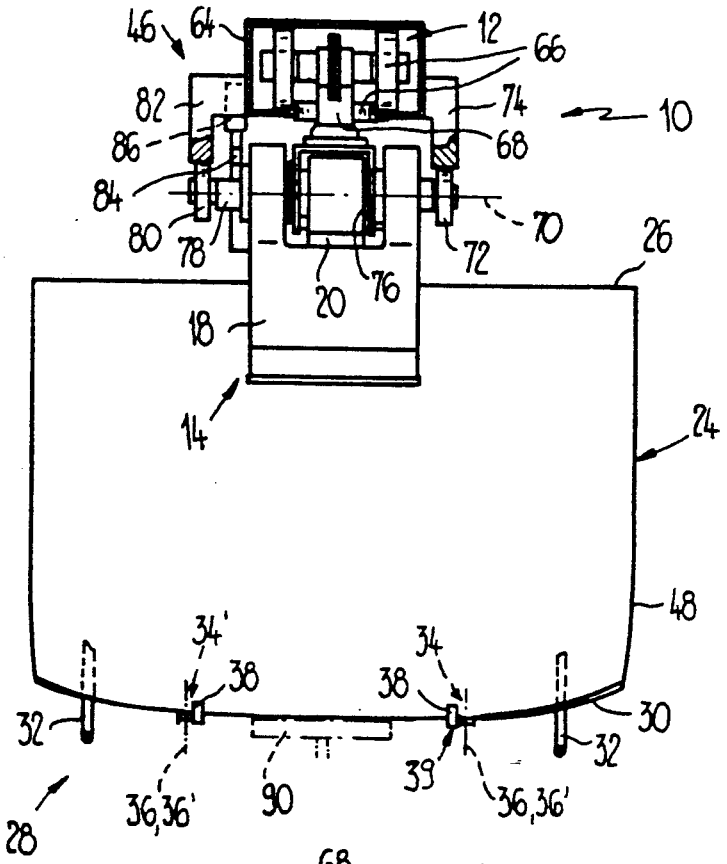
FIGS. 2 and 3 show a top view of a gripper of the conveying device holding a printed product which is to be straightened in the region of the straightening device with the gripper being shown.
Figure 3:
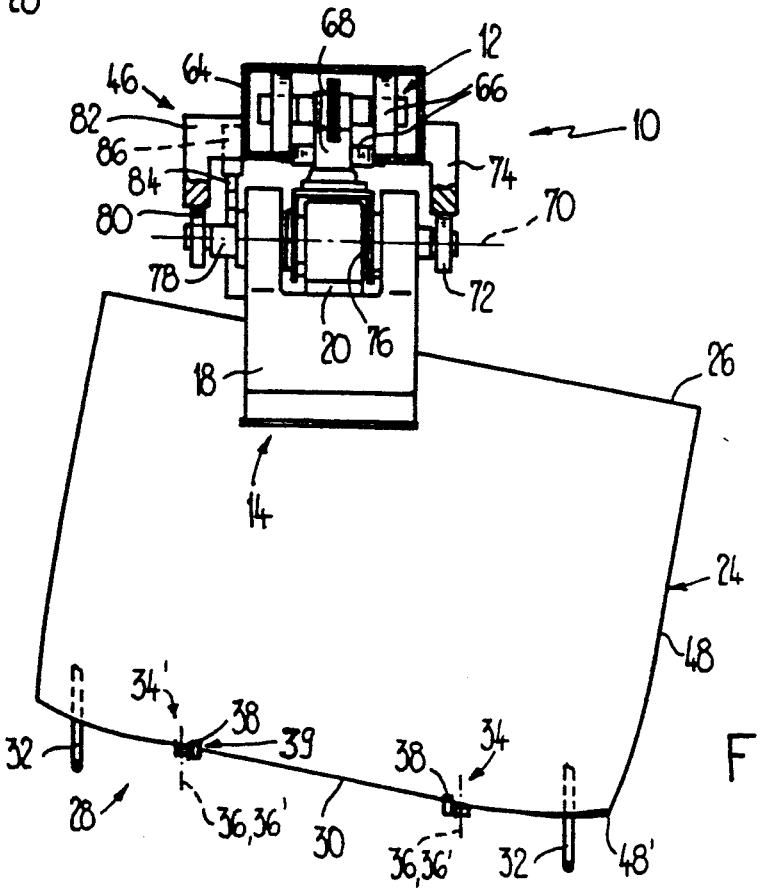

Each of the grippers 14 has a mouth 22 which is bounded by a clamping jaw 18 and clamping finger 20. The clamping finger 20 interacts with the clamping jaw 18 in order to hold a folded printed product 24, such as a magazine, a newspaper, parts thereof, or the like. The folded printed product 24 is held in the region of the fold 26, in the region of the active conveying route of the conveying device 10. A straightening device 28 is arranged below the conveying device 10. The conveying direction F runs from the top obliquely downwards in the region of the straightening device 28. The grippers 14 transport or convey the printed products 24 in a suspended position, so that the open side edge 30 opposite the fold 26 of each printed product 24 is leading relative to the fold 26. In this case, the printed products 24 will slide relative to the conveying device with their leading end region on lateral guide bars 32 which run approximately parallel to the conveying direction F, as is shown in FIGS. 1 through 3.

Located between the guide bars 32, the straightening device 28 has two mutually parallel and, as seen in the conveying direction F laterally spaced-apart chain circulators 34, 34' with straightening mechanism 39. The straightening mechanism 39 may be constructed as straightening cams 38 which are arranged one after another at a fixed distance B on endless chains 36. The endless chains 36 are guided around chain wheels 40 which are indicated by dot/dashed lines (FIG. 1). The chain wheels 40 are spaced apart approximately in the conveying direction F. The chain wheels 40 are mounted on a frame 42 (schematically illustrated) in such a manner that the upper strand 36 which faces the conveying device 10 runs a short distance below the guide bars 32. In this manner, the printed products 24 are bent slightly upwards in the lateral end regions of the leading open edge 30 to improve stability, as seen best in FIGS. 2 and 3.

The distance B between successive straightening cams 38 is slightly smaller than the distance A between successive grippers 14. The upper chain wheels 40 illustrated in FIG. 1 are in drive connection with a drive of the type generally known (not shown in the figures) for the traction or drawing member 12 of the conveying device. The drive connection is preferably a chain drive 44 (indicated only by dot/dashed lines) and driven in such a way that the ratio conveying speed v1 of the conveying device 10 to the speed v2 of the straightening cams 38 is proportional to the ratio of the distance A to the distance B. In this case, the straightening cams 38 move in the region of the upper active straightening strand 36, 36' in the conveying direction F. The synchronization between the straightening device 28 and the conveying device 10 is set such that a straightening cam 38, arriving at the end of the strand 36' (as seen in the conveying direction F) has a predetermined reference distance from the corresponding gripper 14. The corresponding gripper 14 is that gripper 14 which transports that printed product 24 which rests with its leading open edge 30 on the respective straightening cams 38.

The grippers 14 are controllable by means of a control device 46 which is described in more detail below. The grippers 14 are controlled such that the mouth 22 of the grippers 14 at least partially open when a printed product 24 is situated with its leading edge 30 in the region of the upper strand 36'. In this manner, the respective printed product 24 slips forward under its own weight in the conveying direction F and comes to rest on the respective straightening cams 38 of the two chain circulators 34, 34'. As the gripper opens, the printed product 34 moves toward the outside of the mouth 22, but without coming out of engagement with the mouth 22. This is illustrated in FIG. 1 in the second gripper from the rear (as viewed in the conveying direction F). Since, however, the straightening cams 38 move at the speed v2 which is slightly slower than the conveying speed v1, the respective printed product 24 is again pushed towards the interior of the mouth 22 until the straightening cams 38 have reached the end of the strand 36' and are guided around the lower chain wheels 40 out of the range of action on the printed products 24. Shortly before the straightening cams 38 run off the open edge 30 of the printed product 24, the respective gripper 14 is again closed in order to convey the now-aligned printed product 24 in the conveying direction F for further processing. Each printed product 24 which leaves the straightening device 28 has thus attained a precisely defined position relative to the respective gripper 14.

In order to align the printed products 24 with their open leading edge 30, precisely perpendicular to the conveying direction F, the mutually corresponding straightening cams 38 of the two chain circulators 34, 34' are aligned such that they lie on a line running perpendicular to the conveying direction F (as illustrated in FIG. 2). In contrast, if the opening edge 30 is to be aligned obliquely relative to the conveying direction F, the straightening cams 38 of the two chain circulators 34, 34' are correspondingly offset relative to one another in the conveying erection F (as illustrated in FIG. 3). In this case, the corner 48' formed by the open edge 30 and the left side edge 48 of the printed product 24 is leading (as viewed in the conveying direction F).

The straightened printed products 24 are fed by the conveying device 10 to an opening device 50 which is disposed distally and downstream of the straightening device 28. Guide means 52 are provided in the region between the straightening device 28 and the opening device 50. The guide means 52 guides the leading open edges 30 and the adjoining regions of the printed products 24.

The guide means 52 may comprise, for example, a guide plate 52'. The guide means 52 may additionally have a strap 56 guided over the guide plate 52, and around the opening roller 54 of the opening device 50 and a deflecting roller which is mounted on the same axis as the lower chain wheel 40 (not shown in FIG. 1).

Opening cams 58 which are controllable in a known manner are distributed along the circumference of the opening roller 54. The circumferential speed v3 of the opening roller 54 corresponds to the conveying speed v1 of the conveying device 10 (v1=v3). The mutual phase position of the conveying device 10 and the opening roller 54 is set such that the leading open edge 30 of each printed product 24 comes into the range of action of an opening cam 58. The opening cams 58 each grip the lower half 24' of the printed product 24 facing the opening roller 54 and hold it securely on the opening roller 54 in the region of the open edge 30. Due to the deflection around the opening roller 54, the upper, non-gripped half 24" of the printed product 24 separates from the gripped half 24' starting at the open edge 30. A holding-open pin 60 is arranged on a traction element 62 (indicated by dot/dashed lines). The drawing element 62 is driven in the direction of circulation C which is counter to the direction of rotation of the opening roller 54. As illustrated, the holding-open pin 60 is inserted from below between the halves 24', 24" of the printed product which have been separated from one another. Downstream of the opening roller 54, the traction element 62 is guided approximately parallel to the conveying direction 10 in order to keep the opened printed products 24 open during further transport. As soon as the holding-open pin 60 has been inserted between the halves 24', 24" of the printed product, the respective opening cam 58 releases the gripped half 24' of the printed product 24.

It will be recognized that the opening device 50 may be arranged laterally offset relative to the conveying device 10 in order to open the printed products 24 on one side. In this case, of course, the drawing element 62 is guided on the side of the printed products on which they are opened. In the case where the printed product 24 are aligned obliquely in the straightening device 28, (as shown in FIG. 3) the opening roller 54 is preferably located in the region of the leading corner 48' in order to open the printed products 24 in the region of this corner 48'.

The separation of the straightening device 28 from the opening device 40 leads to a clear construction and simplifies the setting of the straightening device 28 and opening device 50 to different formats of the printed products 24. In the case where the length of the printed products 24 changes (as seen in the direction perpendicular to the fold 26), only the phase position between the grippers 14 and the straightening cams 38 and, if appropriate, the opening cams 58 has to be adapted.

As can be seen in FIGS. 2 and 3, the traction member 12 includes a generally known link chain, guided with rollers 66 in a C-shaped, closed-loop rail 64, with extension arms 68 which pass through the slot in the rail 64. The extension arms 68 run in the longitudinal direction of the rail 64 and are arranged at a mutual distance A (central distance). A gripper 14 is arranged on each extension arm 68. Each gripper 14 is pivotally mounted about an axle 70, which runs perpendicular to the conveying direction F. The rigidly constructed clamping jaw 18 which is pivotable about the axle 70 has a position roller 72 which is eccentric relative to the axle 70. The position roller 72 is rotatably mounted and interacts with a position link 74. The clamping finger 20, which is constructed as a leaf spring, is attached by its inner end to a shaft 76. The shaft 76 is rotatable about the axle 70. A bent control lever 78 projects fixedly in terms of rotation from this shaft 76 on the side facing away from the roller 72.

A control roller 80 is rotatably mounted on the free end of the control lever. This control roller 80 interacts with a closing cam or curve 82 (indicated only schematically in FIG. 1). A locking lever 84 is mounted pivotably on the clamping jaw 18. The locking lever interacts with a catch projection (not shown in the figures) on the control lever 78. The locking lever can be moved from the locking position into a release position by means of an opening cam or curve 86. When the grippers 14 are in the closed position, the clamping finger 20 is prestressed towards the clamping jaw 18 which is interlocked via the locking lever 84 and the catch projection. In this state, the grippers 14 are freely pivotable about the axle 70 together with the printed product 24 which are held in the mouth 22, insofar as this is allowed by the position cam 74 and, if appropriate, the closing cam 82.

When a gripper 14 is moved in the conveying direction F towards the straightening device 28, the position roller 72 rolls on the position cam 74 and the control roller 80 runs up against the closing cam 82. Due to the pivoting of the locking lever 84 by the opening cam 86, the interlocking of the clamping jaw 18 and the clamping finger 20 is released. The mouth 22 of the gripper 14, however, does not yet open since the position cam 74 and closing cam 82, acting against one another, are pressing and clamping finger 20, still in a prestressed state, towards the clamping jaw 18. The closing cam 82, then relaxes the prestress of the clamping finger 20 towards the clamping jaw 18. The clamping jaw 18 now acts on the printed product 24 held in the mouth 22 only with its weight acting on the free end. The printed product now slips due to its own weight in the mouth 22 towards the outside until it comes to rest with its leading open edge 30 on the corresponding straightening cams 38 of the straightening device 28.

In order to subsequently close the not completely opened grippers 14, the shaft 76 is pivoted clockwise by the closing cam 82 acting on the control roller 80 until the catch projection on the control lever 78 again engages on the locking lever 84. This occurs at the latest when the open side edge 30 is released by the straightening cams 38. The control device 46 (comprising the position cam 74, the closing cam 82 and opening cam 86) thus ensures that the grippers 14 are only partially opened and then closed again in the correct position in the region of the straightening device 28 and that the grippers 14 are held in the desired position.

A displacing means 90 is indicated by dot/dashed lines in FIG. 2. The displaying means 90 may be, for example, a perforated strap connected to a source of negative pressure and revolvingly driven in the conveying direction F. Its purpose is to urge the printed products 24 to be straightened towards the straightening cams 38. Displacing means 90 of this type may be necessary if light printed products are to be processed or if the conveying direction F runs approximately in the horizontal direction.

It will be recognized that in order to place the printed products 24 obliquely, grippers may be provided which have two spaced apart, individually controllable clamping fingers. In this case, only a single chain circulator (the chain circulator 34 in FIG. 3) is provided in the straightening device 28. In this case, where a printed product 24 is placed obliquely, only one clamping finger, preferably the one nearer to the chain circulator 34, is opened. The printed product 24 is brought to rest on a straightening cam of the chain circulator 34 while the other clamping finger is rotated about the clamping point.

It is also conceivable, in a conveying device and a straightening device as illustrated in FIG. 1, to move the grippers counter to the conveying direction F and to drive the chain circulators clockwise. In this case, the distance B between the straightening cams would be selected to be greater than the distance A between the grippers and the chain circulators would be driven correspondingly faster than the grippers. As soon as the printed products are situated with their now trailing open edge in the region of the straightening device, the relevant gripper is partially opened so that the printed product slips to rest on the straightening cams. The straightening cams now push the respective printed product towards the interior of the mouth until the open side edge has reached the correct position relative to the respective gripper when reaching the end of the straightening device. The straightened printed products are conveyed further by closing the grippers.

It is, of course, also conceivable to open the grippers completely to straighten the printed products or to provide grippers of a different type.

Particularly with a horizontal conveying direction, the printed products do not move towards the outside in the mouth of the grippers, but, for positioning in the gripper, they are pushed towards the interior of the grippers.

The foregoing description of the preferred embodiments of the present invention has been presented for purposes of illustration and description. The preferred embodiments are not intended to be exhaustive or to limit the invention to the precise forms disclosed, and obviously many modifications and variations are possible in light of the above teachings. It is intended that the scope of the invention be defined by the following claims, including all equivalents.

I claim:

1. A method of processing folded printed products, the method comprising the steps of:

providing a conveying device having a plurality of individually controllable grippers arranged at a fixed distance one after the other, the grippers having a mouth and moving in a conveying direction;

driving the grippers in circulation;

providing a straightening mechanism, the straightening mechanism comprising a plurality of straightening cams interacting in each case with a gripper, the straightening cams arranged on a traction element;

driving the traction element in circulation and along a substantially rectilinear strand substantially parallel to the conveying device;

holding the printed products in the mouth of the individually controllable grippers, the printed products being held at a first edge which runs transversely to the conveying direction;

conveying the printed products at a conveying speed in the conveying direction with the grippers;

at least partially opening the mouth of the grippers;

displacing the printed products in the mouth of the grippers when the grippers are at least partially opened;

after the printed products are displaced in the mouth of the grippers, bringing the printed products to rest such that the second edge opposite the first edge rests on the straightening mechanism;

leading the second edge of the printed products relative to the first edge of the printed products;

driving the straightening mechanism at a lower speed than the conveying speed to thrust the printed products towards the interior of the mouth of the grippers;

leading the corresponding straightening cams in the conveying direction relative to the grippers;

arranging the straightening cams such that the distance between successive straightening cams is smaller than the distance between the grippers;

driving the straightening cam at a lower speed than the grippers such that the distance between the relevant grippers and straightening cams, seen in the conveying direction, corresponds at the end of the strand of the straightening device to a reference distance corresponding to the positioning of the printed products; and after the printed products are thrust towards the interior of the mouth of the grippers, closing the grippers to further transport the printed products.

2. The method of claim 1 wherein the step of displacing the printed products in the mouth of the grippers comprises permitting the printed products to slide by their own weight to rest on the straightening mechanism.

3. The method of claim I wherein the step of displacing the printed products in the mouth of the grippers comprises urging the printed products to slide to rest on the straightening mechanism.

4. The method of claim 1 wherein:

the step of conveying the printed products comprises transporting the printed products in a suspended position;

the conveying direction runs obliquely downward; and the printed products come to rest with their lower second edge on the straightening mechanism when the grippers are opened.

5. The method of claim 1 wherein the straightening mechanism comprises at least two straightening cams spaced transversely apart from each other in the conveying direction and further comprising the step of arranging the cams on a line perpendicular to the conveying direction.

6. The method of claim 1 wherein the straightening mechanism comprises at least two straightening cams spaced transversely apart from each other in the conveying direction and further comprising the step of arranging the cams offset relative to one another in the conveying direction to position the printed products obliquely.

7. The method of claim 1 wherein the step of holding the printed products comprises the step of holding the printed products in the region of their fold and comprising the step of transporting the printed products to an opening device with the open edge of the printed products opposite the fold.

8. An apparatus for processing folded printed products comprising:

a conveying device having individually controllable grippers which are moved in a conveying direction at a conveying speed, the grippers having a mouth for holding the printed products at a first edge, the first edge running transversely to the conveying direction;

a control device for the temporary, at least partial opening of the grippers;

a straightening device, disposed below the conveying device, the straightening device having a straightening mechanism which is driven approximately in the conveying direction, the straightening mechanism arranged such that the printed products can be brought to rest with their second edge opposite the first edge when the grippers are at least partially opened;

a gripper closing mechanism for reclosing the grippers after the straightening of the printed products to further transport the printed products;

the straightening mechanism being leading in the conveying direction relative to the grippers and being driven at a different speed from the conveying speed, the speed being lower than the conveying speed in order to position the printed products relative to the grippers by thrusting them towards the interior of the mouth in the opened grippers;

the conveying device including a plurality of grippers arranged at a fixed distance one after the other and driven in circulation, the straightening device including a plurality of straightening mechanisms interacting in each case with a gripper;

the straightening mechanisms comprising straightening cams arranged on a traction element driven in circulation and along a substantially rectilinear strand substantially parallel to the conveying device;

the corresponding straightening cams leading in the conveying direction relative to the grippers, the distance between successive straightening cams being smaller than the distance between the grippers, and the straightening cams being driven at a lower speed than the grippers such that the distance between the relevant grippers and straightening cams, seen in the conveying direction, corresponds at the end of the strand of the straightening device to a reference distance corresponding to the positioning of the printed products.

9. The apparatus of claim 8, wherein the traction element comprises two mutually parallel traction members which are spaced apart perpendicular to each other to the conveying direction, the traction members being drivable and mutually corresponding straightening cams being disposed such that they are arranged on a line running perpendicular to the conveying direction.

10. The apparatus of claim 8, wherein the traction element comprises two mutually parallel traction members which are spaced apart perpendicular to each other to the conveying direction, the traction members being drivable and mutually corresponding straightening cams being arranged such that they are offset relative to one another in the conveying direction for placing the printed products obliquely.

11. The apparatus of claim 8, wherein the grippers are constructed for gripping folded printed products in the region of their fold, and an opening device is connected, at a distance, downstream of the straightening device, wherein the printed products are fed with the open edge opposite the fold.

12. The apparatus of claim 11, wherein the opening device comprises opening cams for gripping a part of the printed products, the opening cams being driven at a different speed from the conveying speed of the grippers, and wherein the open edges of the printed products are brought into the range of action of the opening cams as a result of these different speeds.

13. The apparatus as claimed in claim 11, wherein the printed products are fed to the opening device with the leading open edge, the opening cams being driven at a lower speed relative to the conveying speed, and comprising guide means for the leading edges of the printed products, the guide means disposed between the straightening device and the opening device.

14. The apparatus according to claim 8, comprising displacing means for bringing the printed products to rest on the straightening mechanism when the grippers are at least partially opened.

15. The apparatus according to claim 8 wherein:

the conveying device transports the printed products in a suspended position and the conveying direction runs obliquely downward; and the printed products come to rest with their lower second edge on the straightening mechanism when the grippers are opened.

16. The apparatus according to claim 8 wherein:

the conveying device transports the printed products in a suspended position and the conveying direction runs obliquely downward; and the printed products come to rest with their lower second edge on the straightening mechanism when the grippers are opened.

17. An apparatus for processing folded printed products comprising:

a conveying device having individually controllable grippers which are moved in a conveying direction at a conveying speed, the grippers having a mouth for holding the printed products at a first edge, the first edge running transversely to the conveying direction;

a control device for the temporary, at least partial opening of the grippers;

a straightening device, disposed below the conveying device, the straightening device having a straightening mechanism which is driven approximately in the conveying direction, the straightening mechanism arranged such that the printed products can be brought to rest with their second edge opposite the first edge when the grippers are at least partially opened;

a gripper closing mechanism for reclosing the grippers after the straightening of the printed products to further transport the printed products;

the straightening mechanism being trailing in the conveying direction relative to the grippers and being driven at a different speed from the conveying speed, the speed being higher than the conveying speed in order to position the printed products relative to the grippers by thrusting them towards the interior of the mouth in the opened grippers;

the conveying device including a plurality of grippers arranged at a fixed distance one after the other and driven in circulation, the straightening device including a plurality of straightening mechanisms interacting in each case with a gripper;

the straightening mechanisms comprising straightening cams arranged on a traction element driven in circulation and along a substantially rectilinear strand substantially parallel to the conveying device;

the corresponding straightening cams trailing in the conveying direction relative to the grippers, the distance between successive straightening cams being greater than the distance between the grippers, and the straightening cams being driven at a higher speed than the grippers such that the distance between the relevant grippers and straightening cams, seen in the conveying direction, corresponds at the end of the strand of the straightening device to a reference distance corresponding to the positioning of the printed products.

18. The apparatus of claim 17, wherein the traction element comprises two mutually parallel traction members which are spaced apart perpendicular to each other to the conveying direction, the traction members being drivable and mutually corresponding straightening cams being disposed such that they are arranged on a line running perpendicular to the conveying direction.

19. The apparatus of claim 17, wherein the traction element comprises two mutually parallel traction members which are spaced apart perpendicular to each other to the conveying direction, the traction members being drivable and the mutually corresponding straightening cams being arranged such that they are offset relative to one another in the conveying direction for placing the printed products obliquely.

20. The apparatus of claim 17 wherein the printed products have a fold and wherein the grippers are constructed for gripping folded printed products in the region of their fold, and an opening device is connected, at a distance, downstream of the straightening device, wherein the printed products are fed with the open edge opposite the fold.

21. The apparatus of claim 20, wherein the opening device comprises opening cams for gripping a part of the printed products, the opening cams being driven at a different speed from the conveying speed of the grippers, and wherein the open edges of the printed products are brought into the range of action of the opening cams as a result of these different speeds.

22. The apparatus according to claim 17 comprising displacing means for bringing the printed products to rest on the straightening mechanism when the grippers are at least partially opened.

23. The apparatus according to claim 17 wherein:

the conveying device transports the printed products in a suspended position and the conveying direction runs obliquely upwards; and the printed products come to rest with their lower second edge on the straightening mechanism when the grippers are opened.

24. A method of processing folded printed products, the method comprising the steps of:

providing a conveying device having a plurality of individually controllable grippers arranged at a fixed distance one after the other, the gripers having a mouth and moving in a conveying direction;

driving the grippers in circulation;

providing a straightening mechanism, the straightening mechanism comprising a plurality of straightening cams interacting in each case with a gripper, the straightening cams arranged on a traction element;

driving the traction element in circulation and along a substantially rectilinear strand substantially parallel to the conveying device;

holding the printed products in the mouth of the individually controllable grippers, the printed products being held at a first edge which runs transversely to the conveying direction;

conveying the printed products at a conveying speed in the conveying direction with the grippers;

at least partially opening the mouth of the grippers;

displacing the printed products in the mouth of the grippers when the grippers are at least partially opened;

after the printed products are displaced in the mouth of the grippers, bringing the printed products to rest such that the second edge opposite the first edge rests on the straightening mechanism;

leading the second edge of the printed products relative to the first edge of the printed products;

driving the straightening mechanism at a higher speed than the conveying speed to thrust the printed products towards the interior of the mouth of the grippers;

trailing the corresponding straightening cams in the conveying direction relative to the grippers;

arranging the straightening cams such that the distance between successive straightening cams is smaller than the distance between the grippers;

driving the straightening cam at a lower speed than the grippers such that the distance between the relevant grippers and straightening cams, seen in the conveying direction, corresponds at the end of the strand of the straightening device to a reference distance corresponding to the positioning of the printed products; and after the printed products are thrust towards the interior of the mouth of the grippers, closing the grippers to further transport the printed products.

25. The method of claim 24 wherein the step of displacing the printed products in the mouth of the grippers comprises permitting the printed products to slide by their own weight to rest on the straightening mechanism.

26. The method of claim 24 wherein the step of displacing the printed products in the mouth of the grippers comprises urging the printed products to slide to rest on the straightening mechanism.

27. The method of claim 24 wherein:

the step of conveying the printed products comprises transporting the printed products in a suspended position;

the conveying direction runs obliquely upwards; and the printed products come to rest with their lower second edge on the straightening mechanism when the grippers are opened.

28. The method of claim 24 wherein the straightening mechanism comprises at least two straightening cams spaced transversely apart from each other in the conveying direction and further comprising the step of arranging the cams on a line perpendicular to the conveying direction.

29. The method of claim 24 wherein the straightening mechanism comprises at least two straightening cams spaced transversely apart from each other in the conveying direction and further comprising the step of arranging the cams offset relative to one another in the conveying direction to position the printed products obliquely.

30. The method of claim 24 wherein the step of holding the printed products comprises the step of holding the printed products in the region of their fold and comprising the step of transportion the printed products to an opening device with the open edge of the printed products opposite the fold.

* * * * *

UNITED STATES PATENT AND TRADEMARK OFFICE

CERTIFICATE OF CORRECTION

PATENT NO. : 5,301,937
DATED : April 12, 1994
INVENTOR(S) : Egon Hansch

It is certified that error appears in the above-indentified patent and that said Letters Patent is hereby corrected as shown below:

In column 2, line 18, delete "positioned" and substitute --position--.

In column 3, line 33, delete "-".

In column 5, line 56, delete "product" and substitute --products--.

In column 7, line 2, delete "displaying" and substitute --displacing--.

IN THE CLAIMS

In claim 3, line 1, delete "I" and substitute --1--.

In claim 24, line 5, delete "gripers" and substitute --grippers--.

UNITED STATES PATENT AND TRADEMARK OFFICE

CERTIFICATE OF CORRECTION

PATENT NO. : 5,301,937
DATED : April 12, 1994
INVENTOR(S) : Egon Hansch

It is certified that error appears in the above-indentified patent and that said Letters Patent is hereby corrected as shown below:

Col. 12, In claim 24, line 30, delete "second" and substitute --first--.

In claim 24, line 31, delete "first" and substitute --second--.

In claim 24, line 40, delete "smaller" and substitute --greater--.

In claim 24, line 41, delete "lower" and substitute --higher--.

Col. 14, In claim 30, line 4, delete "transportation" and substitute --transporting--.

Signed and Sealed this

Twenty-fourth Day of January, 1995

*Attest:*

Bruce Lehman

BRUCE LEHMAN

*Attesting Officer*

*Commissioner of Patents and Trademarks*